US005144745A

United States Patent [19]

Yoshimura et al.

[11] Patent Number: 5,144,745

[45] Date of Patent: Sep. 8, 1992

[54] METHOD OF MANUFACTURING ACCELERATION SENSOR

[75] Inventors: Kazuo Yoshimura; Shigeru Shimozono; Ryo Satoh, all of Kanagawa, Japan

[73] Assignee: Takata Corporation, Tokyo, Japan

[21] Appl. No.: 735,935

[22] Filed: Jul. 25, 1991

[30] Foreign Application Priority Data

Aug. 23, 1990 [JP] Japan ..... 2-221998

[51] Int. Cl.[5] ..... H01F 7/06

[52] U.S. Cl. ..... 29/602.1; 29/606; 29/607; 264/272.19

[58] Field of Search ..... 29/602.1, 606, 607; 73/517 R, 517 B, 654; 200/61.45 M, 61.53; 264/272.19

[56] References Cited

U.S. PATENT DOCUMENTS

| | | | |
|---|---|---|---|
| 4,322,648 | 3/1982 | Ray et al. | 310/156 |
| 4,410,769 | 10/1983 | Tibbetts | 310/25 |
| 4,606,305 | 8/1986 | Campen | 310/153 |
| 4,827,091 | 5/1989 | Behr et al. | 200/61.45 M |
| 4,922,065 | 5/1990 | Behr et al. | 200/61.45 M |
| 4,943,791 | 7/1990 | Holce et al. | 335/151 |

FOREIGN PATENT DOCUMENTS

| | | | |
|---|---|---|---|
| 234506 | 9/1988 | Japan | 29/602.1 |

*Primary Examiner*—P. W. Echols

*Attorney, Agent, or Firm*—Kanesaka and Takeuchi

[57] ABSTRACT

Disclosed is a method of manufacturing an acceleration sensor including: a cylindrical body composed of a conductive material; a magnetized inertial body so charged in an interior of the cylindrical body as to be movable in the longitudinal direction of the cylindrical body; a conductive body provided on an end surface of at least one end of the magnetized inertial body in the longitudinal direction of the cylindrical body; a pair of electrodes disposed at one end in the longitudinal direction of the cylindrical body and made conductive through the conductive body when contacting the conductive body of the magnetized inertial body; and an attracting body composed of a magnetic material, disposed at the other end in the longitudinal direction of the cylindrical body and magnetically mutually attracting the magnetized inertial body, the method comprising the steps of: assembling the acceleration sensor by incorporating the inertial body before becoming the magnetized inertial body by magnetization; and magnetizing the inertial body by thereafter applying a magnetic field to this assembled unit.

6 Claims, 2 Drawing Sheets

METHOD OF MANUFACTURING ACCELERATION SENSOR

BACKGROUND OF THE INVENTION

1. Field of the Invention

The present invention relates generally to a method of manufacturing an acceleration sensor, and more particularly, to an acceleration sensor manufacturing method suited to detect a large variation in velocity which is caused in the event of a collision of a vehicle.

2. Description of the Prior Art

This type of acceleration sensor was disclosed in U.S. Pat. No. 4,827,091. This sensor includes: a cylindrical body formed of a conductive material; a magnetized inertial body so positioned in an interior of the cylindrical body as to be movable in the longitudinal direction of the cylindrical body; a conductive body provided on an end surface of at least one end of the magnetized inertial body in the longitudinal direction of the cylindrical body; a pair of electrodes disposed at one end in the longitudinal direction of the cylindrical body and made conductive through the conductive body when contacting the conductive body of the magnetized inertial body; and an attracting body composed of a magnetic material, disposed at the other end in the longitudinal direction of the cylindrical body and magnetically mutually attracting the magnetized inertial body.

In this acceleration sensor, the magnetized inertial body and the attracting body attract each other. When absolutely or almost no acceleration is applied to the acceleration sensor, the magnetized inertial body is stably situated at the other end of the interior of the cylindrical body.

If a relatively large acceleration is applied to this acceleration sensor, the magnetized inertial body moves while resisting the attracting force associated with the attracting body. When the magnetized inertial body is going to move, an induced current flows in this cylindrical body. A magnetic force for biasing in a direction opposite to the moving direction is imparted to the magnetized inertial body, and it follows that the magnetized inertial body is brought into a braked state. A moving velocity thereof is decreased.

If the acceleration is smaller than a predetermined value (threshold value), the magnetized inertial body does not reach the top end of the cylindrical body. Instead, the magnetized inertial body stops midway and is subsequently returned to the other end by the attracting force associated with the attracting body.

Whereas if the acceleration is greater than the predetermined value (threshold value) (i.e., in the event of a collision of a vehicle mounted with this acceleration sensor), the magnetized inertial body reaches one end of the cylindrical body. A conductive layer on the top end surface of the magnetized inertial body contacts a pair of electrodes. The electrodes are thereby made conductive to each other. If a voltage is applied beforehand between the electrodes, the current flows in between the electrodes just when the electrodes short-circuit each other. The collision of the vehicle is detected from this current.

In the case of manufacturing the acceleration sensor in the prior art, the previously magnetized inertial body has hitherto been inserted into the cylindrical body. This method, however, presents a variety of drawbacks to the assembling operation in which the inertial body to be assembled attracted to an iron tool or operating board in the manufacturing work place because of the inertial body being magnetized.

OBJECT AND SUMMARY OF THE INVENTION

It is an object of the present invention to provide a method of manufacturing an acceleration sensor which is capable of efficiently performing manufacturing operations.

The method of this invention aims at surely manufacturing the acceleration sensor exhibiting predetermined characteristics by adjusting a magnetization quantity of a magnetized inertial body.

According to one aspect of the invention, there is provided a method of manufacturing an acceleration sensor including: a cylindrical body composed of a conductive material; a magnetized inertial body located in an interior of the cylindrical body as to be movable in the longitudinal direction of the cylindrical body; a conductive body provided on an end surface of the magnetized inertial body, the end surface extending normal to the longitudinal direction of the cylindrical body; a pair of electrodes disposed at one end of the cylindrical body and made conductive through the conductive body when contacting with the conductive body of the magnetized inertial body; and an attracting body composed of a magnetic material, disposed at a side of the cylindrical body opposite to the electrodes and magnetically mutually attracting the magnetized inertial body, the method comprising the steps of: assembling the acceleration sensor by incorporating the inertial body prior to magnetization of the inertial body; and magnetizing the inertial body by thereafter applying a magnetic field to this assembled unit.

Based on the method of manufacturing the acceleration sensor according to the present invention, after magnetizing the inertial body in the way described above, the characteristics of the acceleration sensor are measured. The magnetization quantity of the inertial body is adjusted preferably based on the result of this measurement.

Based on the method of manufacturing the acceleration sensor according to the present invention, the inertial body before being magnetized is incorporated into the cylindrical body. This inertial body is not attracted to the iron tool or operating board at all. For this reason, the assembling operations are highly facilitated.

Based on the method according to the present invention, the acceleration sensor having the predetermined characteristics can be manufactured by adjusting the magnetization quantity of the magnetized inertial body.

BRIEF DESCRIPTION OF THE DRAWINGS

Other objects and advantages of the invention will become apparent during the following discussion taken in conjunction with the accompanying drawings, in which.

DETAILED DESCRIPTION OF THE PREFERRED EMBODIMENT

Figure 1:
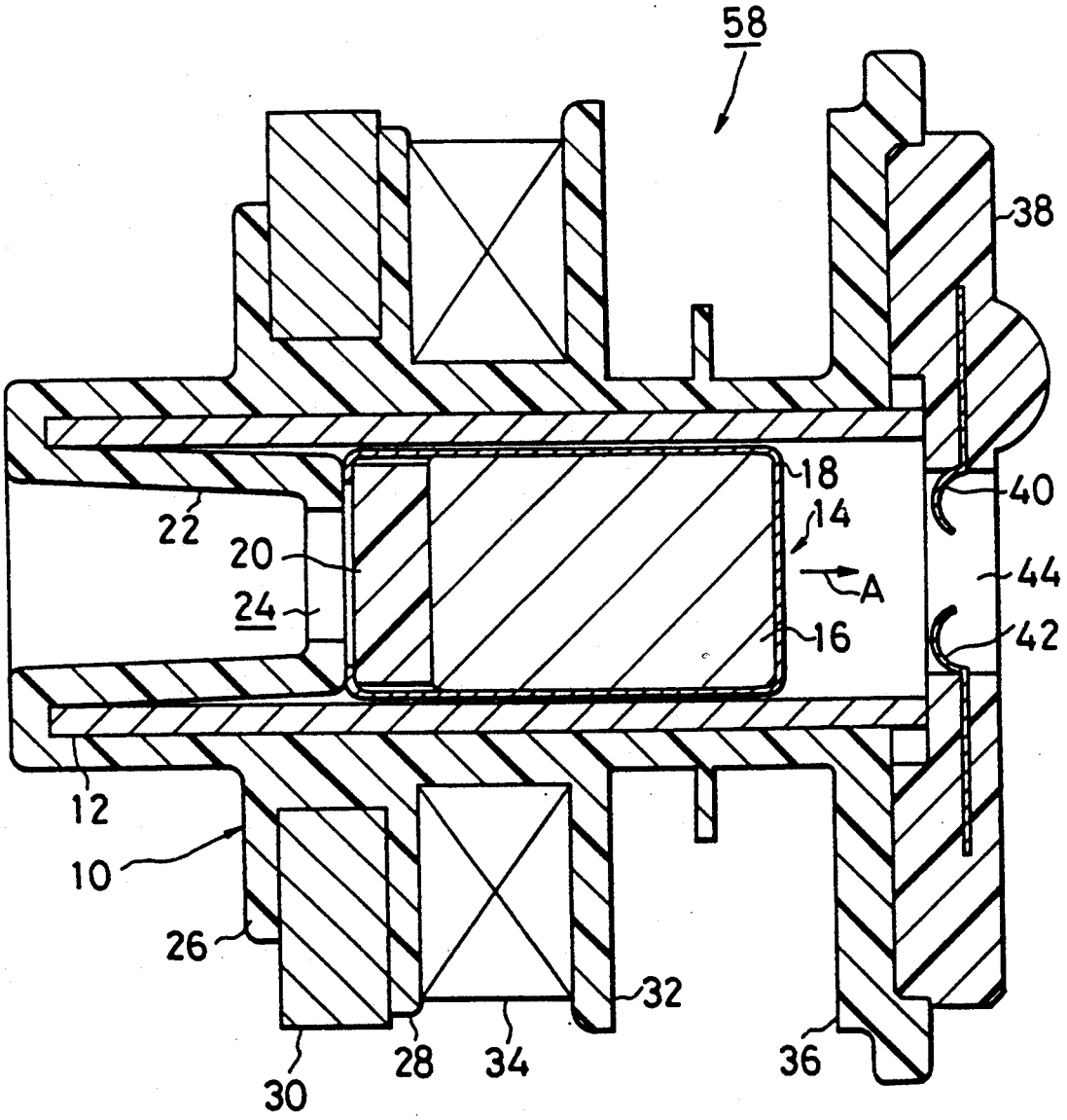
FIG. 1 is a sectional view depicting an acceleration sensor manufactured by a method according to the present invention.

Referring to FIG. 1, a cylindrical body 12 composed of a copper alloy is held in an interior of a cylindrical bobbin 10 formed of a non-magnetic material such as a synthetic resin. A magnetized inertial body (magnet assembly) 14 is positioned in an interior of the cylindrical body 12. This magnet assembly 14 includes a cylindrical permanent magnet 16, a cylindrical case 18 without a bottom formed of a non-magnetic conductive material such as copper for encasing the magnet 16 and a packing 20 composed of a synthetic resin to keep the magnet 16 in the case 18. This magnet assembly 14 is so positioned in the interior of the cylindrical body 12 as to be movable in the longitudinal direction of the cylindrical body 12.

The bobbin 10 has one end serving as an inner part 22 which is located in the interior of the cylindrical body 12. An opening 24 is formed in the top end of the inner part 22. The bobbin 10 is provided with a pair of flanges 26 and 28 protruding sideways from a side portion of the top end of the inner part 22. Sandwiched in between these flanges 26 and 28 is a ring-like attracting body (return washer) 30 formed of a magnetic material such as iron.

The bobbin 10 is provided with another flange 32. A coil 34 is wound between the flanges 28 and 32. A still another flange 36 is provided at the other end of the bobbin 10. A contact holder 38 is fitted to this flange 36.

This contact holder is composed of a synthetic resin and includes a pair of electrodes 40 and 42 embedded therein. Top ends of the electrodes 40 and 42 protrude into the opening 44 of the central part of the contact holder 38. The top ends of the electrodes 40 and 42 are also bent in circular arcs and so positioned as to be partially substantially flush with the top end surface of the cylindrical body 12.

Lead wires are, though not illustrated, connected to the rear ends of the electrodes 40 and 42, whereby a voltage is applicable between the electrodes 40 and 42.

In the thus constructed acceleration sensor, the magnet assembly 14 and the return washer 30 attract each other in a state where no external force is exerted. As a result, the rear end of the magnet assembly 14 is positioned to an illustrated back retreat limit enough to impinge on the top end surface of the inner part 22. If the external force acts in an arrowed direction A, the magnet assembly 14 moves in the arrowed direction A, resisting the attracting force with respect to the return washer 30. With this movement, an induced current flows in the cylindrical body 12 composed of the copper-alloy. A magnetic field produced by this induced current imparts a magnetic force acting in a direction opposite to the moving direction to the magnet assembly 14. The magnet assembly 14 is thereby braked.

If the external force exerted on the acceleration sensor is small, the magnet assembly 14 stops when reaching a mid-portion of the cylindrical body 12. Eventually, the magnet assembly 14 returns to the back retreat limit shown in FIG. 1 by dint of the attracting force caused between the return washer 30 and the magnet assembly 14.

If a large external force produced in the event of a collision of a vehicle is exerted in the arrowed direction A, the magnet assembly 14 moves forwards to the top end of the cylindrical body 12 and contacts the electrodes 40 and 42. Thereupon, the case 18, formed of the conductive material, of the magnet assembly 14 short-circuits the electrodes 40 and 42. The current thereby flows in between the electrodes 40 and 42. Consequently, it is detected that a variation in the acceleration which is greater than a predetermined threshold value is caused. The collision of the vehicle is thereby detected.

Note that the coil 34 serves to check the operations of the acceleration sensor. More specifically, when the coil 34 is charged with the electricity, a magnetic field to bias the magnet assembly 14 in the arrowed direction A is produced from the coil 34. The magnet assembly 14 moves forwards to the top end of the cylindrical body 12 and short-circuits the electrodes 40 and 42. The magnet assembly 14 is forcibly moved by electrifying the coil 34 in this manner. It is therefore possible to check whether or not the magnet assembly 14 is capable of normally advancing and retreating and whether or not the electrodes 40 and 42 are short-circuited.

Figure 2:
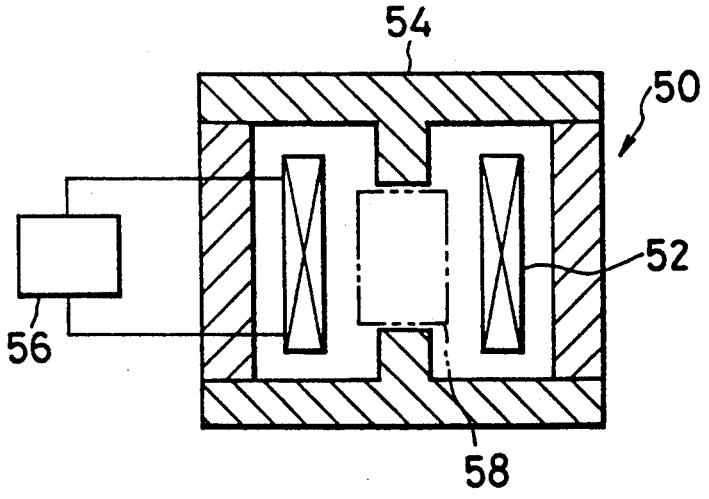
FIG. 2 is a side view in explaining a magnetizing method.

Manufacturing of this acceleration sensor involves the following steps. To start with, the bobbin 10 is formed by an injection molding method. The bobbin 10 equipped with the cylindrical body 12, the return washer 30 and the coil 34 are manufactured by an insert molding method wherein the cylindrical body 12, the return washer 30 and the coil 34 are set in a metal mold, and the resin is injected therein. Next, the magnet assembly 14 including an unmagnetized magnet 16 (magnet element) is inserted into the cylindrical body 12. The contact holder 38 is fixed to the flange 36 by bonding or welding to manufacture an assembled unit 58. Thereafter, this assembled unit 58 is, as illustrated in FIG. 2, set in a magnetic field application device 50. A magnetic field is applied to permit a magnetic flux to flow in a direction parallel with a longitudinal axis of the cylindrical magnet 16. The magnet 16 is thereby magnetized. The acceleration sensor is thus completed. Note that the numeral 52 designates a coil, 54 represents an iron core, 56 denotes a DC supply, and 58 indicates an acceleration sensor to be magnetized, in FIG. 2.

Thereafter, the operation of the completed acceleration sensor is checked. A magnetization quantity of the magnet 16 is adjusted as the necessity arises. When effecting this operation check, the coil 34 is charged with a predetermined current to move the magnet assembly 14 in the arrowed direction A. A time period from a start of electrifying the coil 34 to short-circuiting of the electrodes 40 and 42 is measured. If this period is shorter than a predetermined period, the magnetization quantity of the magnet 16 is reduced. This reduction requires the steps of setting the acceleration sensor in a magnetizing device depicted in FIG. 2 and applying, to the acceleration sensor, a weak magnetic field acting in a direction opposite to the direction when being magnetized.

Note that in a normal case, the element of the unmagnetized magnet 16 is magnetized by applying, to the element, a magnetic field exhibiting a magnetic flux density equal to or greater than a saturated magnetic flux density of the magnet element. The magnet 16 is thus saturation-magnetized. Then, characteristics of the acceleration sensor are measured in the manner described above. After this measurement, the magnetization quantity of the magnet 16 is reduced in accordance with a result of the measurement.

As discussed above, in the method of manufacturing the acceleration sensor according to the present invention, the inertial body before effecting the magnetization is incorporated into the cylindrical body. The inertial body is magnetized after completing the whole device. With this arrangement, the inertial body is not attracted to an iron tool or table in the work place. This facilitates handling of the inertial body. For this reason, a manufacturing operative efficiency of the acceleration sensor is improved.

Based on the method of the present invention, it is feasible to surely manufacture the acceleration sensor exhibiting the predetermined characteristics by adjusting the magnetization quantity of the magnetized inertial body.

Although the illustrative embodiments have been described in detail with reference to the accompanying drawings, it is to be understood that the present invention is not limited to those embodiments. Various changes or modifications may be effected therein by one skilled in the art without departing from the scope or spirit of the invention.

What is claimed is:

1. A method of manufacturing an acceleration sensor, comprising the steps of:

setting, in a mold, a cylindrical body composed of a conductive material and a ring-like attracting body disposed outside an outer periphery of said cylindrical body and composed of a magnetic material;

introducing a resin into said mold, applying the resin along the outer periphery of said cylindrical body and interposing the resin between said ring-like attracting body and the outer periphery of said cylindrical body to form a molding;

curing the resin in said mold;

taking the molding out of said mold;

inserting an unmagnetized inertial body into said cylindrical body of said molding;

fitting electrodes to one end of said cylindrical body of said molding; and magnetizing said inertial body by applying a magnetic field to said inertial body.

2. The method as set forth in claim 1, wherein a coil is disposed to surround said cylindrical body in said mold, and a portion between an inner periphery of said coil and the outer periphery of said cylindrical body is filled with the resin by introducing the resin into the mold.

3. The method as set forth in claim 1, wherein characteristics of said acceleration sensor are measured after magnetizing said inertial body, and a magnetization quantity of said inertial body is adjusted based on a result of this measurement.

4. The method as set forth in claim 3, wherein said inertial body is saturation-magnetized by applying a magnetic field exhibiting a magnetic flux density equal to or greater than a saturated magnetic flux density of said inertial body, and thereafter the magnetization quantity is reduced down to a target magnetization quantity.

5. The method as set forth in claim 3, wherein the magnetic field is applied in a direction opposite to the direction when magnetizing as a method of reducing the magnetization quantity.

6. The method as set forth in claim 1, wherein the magnetic field is applied to permit the magnetic flux to flow in a direction parallel with the longitudinal axis of said cylindrical body.

* * * * *